US006094776A

United States Patent [19]

Fish

[11] Patent Number: 6,094,776

[45] Date of Patent: Aug. 1, 2000

[54] BRUSH AND SPACER ASSEMBLY FOR A VACUUM CLEANER

[75] Inventor: William G. Fish, Gulfport, Miss.

[73] Assignee: Oreck Holdings, LLC, Cheyenne, Wyo.

[21] Appl. No.: 09/060,457

[22] Filed: Apr. 14, 1998

[51] Int. Cl.[7] ..... A47L 5/00

[52] U.S. Cl. ..... 15/398; 15/364; 15/400; 15/42

[58] Field of Search ..... 15/364, 42, 398, 15/400, 416, 420, 367

[56] References Cited

U.S. PATENT DOCUMENTS

| | | | |
|---|---|---|---|
| 3,748,679 | 7/1973 | Rosendall | 15/42 |
| 3,874,016 | 4/1975 | Liebscher | 15/42 |
| 3,978,539 | 9/1976 | Yonkers | 15/42 |
| 4,168,561 | 9/1979 | Rosendall | 15/42 |
| 4,198,727 | 4/1980 | Farmer | 15/400 |
| 4,219,902 | 9/1980 | DeMaagd | 15/364 |

FOREIGN PATENT DOCUMENTS

| | | | |
|---|---|---|---|
| 20 55 841 | 5/1972 | Germany | 15/42 |
| 2 159 044 | 11/1985 | United Kingdom | 15/42 |

*Primary Examiner*—William H. Beisner
*Attorney, Agent, or Firm*—Seed and Berry LLP

[57] ABSTRACT

A removable brush spacer assembly for attachment to the lateral edge of a vacuum cleaner nozzle in order to support an edge brush and to space the brush with respect to a surface is shown and described. The brush spacer assembly incorporates an elongated main body having a base, a plurality of bristles collectively forming an edge brush, and a spacer. The brush is attached at one end to the main body, with the bristles projecting toward the surface being vacuumed. The spacer is attached to the main body and projects below the base to control the relationship of the brush with respect to the surface.

17 Claims, 4 Drawing Sheets

BRUSH AND SPACER ASSEMBLY FOR A VACUUM CLEANER

TECHNICAL FIELD

The invention is directed to a brush and spacer assembly and, more particularly, to an assembly for spacing a vacuum cleaner nozzle from a surface being vacuumed.

BACKGROUND OF THE INVENTION

FIG. 1 shows a vacuum cleaner 10 according to the prior art. The illustrated vacuum cleaner 10 has a handle 12, a nozzle 14 and a dirt receiving receptacle 16. A dirty air conduit 18 connects the nozzle 14 to the dirt receiving receptacle 16. The nozzle 14 has a front portion 20 and a rear portion 22. A resilient bumper 24 surrounds the nozzle 14 to protect walls and furniture from damage. Other types of vacuum cleaners can be equipped with separate nozzles 14 that can be powered or un-powered.

The vacuum cleaner 10 removes dirt from a carpet by creating a suction under the nozzle 14 of the vacuum cleaner 10 that is strong enough to draw the dirt particles from a section of the floor into the vacuum cleaner 10. The dirty air travels from the nozzle 14, through the dirty air conduit 18, and into the dirt receiving receptacle 16 where the entrained dirt is captured.

FIG. 2 shows the nozzle 14 of the prior art from below. A fan (not shown) draws dirty air from the carpet or floor into the vacuum cleaner 10 through an opening 26 in the nozzle 14. To increase the efficiency of this process, the opening 26 in the nozzle 14 of the vacuum cleaner 10 often has a roller brush 28 for agitating dirt from the carpet as it is being vacuumed.

The underside of the nozzle 14 is covered with a bottom panel 30. The bottom panel 30 has a lowered section 32 corresponding to the front portion 20 of the nozzle 14, and an elevated section 34 corresponding to the rear portion 22 of the nozzle 14. The lowered section 32 encircles the opening 26, and extends roughly one-half inch below the elevated section 34, as defined when the nozzle 14 is in the position of use. When the vacuum cleaner 10 is in this position, the lowered section 32 contacts the floor.

Two support wheels 36 extend through the elevated section 34 of the bottom panel 30 toward the rear portion 22 of the nozzle 14. Each support wheel 36 is approximately one and one-half inch in diameter and one inch wide and extends approximately one-half inch below the surface of the bottom panel 30, countering the tilting effect that the lowered section 32 has on the nozzle 14, and causing the nozzle 14 to sit level. Both of the support wheels 36 are large enough to raise the nozzle 14 above the floor whether the vacuum cleaner 10 is operating on a hard surface or carpet.

Generally, when the vacuum cleaner 10 is operating, the decreased pressure under the nozzle 14 caused by the evacuation of air into the opening 26 causes the surrounding air to flow under the nozzle 14. The smaller the gap between the nozzle 14 and the floor, the higher the velocity of the air rushing under the nozzle 14. One upright vacuum in particular, the ORECK Model XL9100HG, utilizes a pair of channels 38 to concentrate this rushing air from the sides of the nozzle 14. This concentrated suction can draw dirt particles from the base of a wall or a base board under the nozzle 14 and direct the dirt-entrained air into the opening 26. A similar design is disclosed in U.S. Pat. No. 4,219,902 to DeMaagd. To aid in releasing dirt particles from the bottom of walls or base boards, angled bristles 44 are mounted to the lowered section 32 of the bottom panel 30. The angled bristles 44 are directed downward and to the side, toward the intersection of a wall (not shown) with a floor 46 (FIG. 4).

As shown in FIG. 3, the portion of the lowered section 32 that extends along the bottom of the front portion 20 of the nozzle 14 is made up of alternating teeth 40 and gaps 42. This structure creates increased air flow velocity into the opening 26 from the front of the vacuum cleaner 10.

One problem with this design is that the angled bristles 44 eventually become distorted beyond the point of elasticity and can no longer serve their intended purpose. When the nozzle 14 is in the position of use, as shown in FIG. 4, the lowered portion 32 of the bottom panel 30 of the nozzle 14 sits flat on the floor 46. This causes the angled bristles 44 to be flared into a horizontal orientation. Whether the nozzle 14 is being used or stored in this position, the angled bristles 44 are held in this position. Eventually, the angled bristles 44 permanently retain this position, and no longer exert any downward force against the floor. If the angled bristles 44 become so distorted that they begin to turn upward, the angled bristles 44 no longer effectively remove dirt from the corner.

Another problem with this design is that the lowered section 32 of the bottom panel 30 contacts the floor. The edges and corners of the lowered section 32 can scratch linoleum and hardwood floors. As the angled bristles 44 lose their resilience, the force that these edges and corners exert on the floor can increase and cause even greater damage. Even worse, the portions of the nozzle 14 that contact the floor can become embedded with glass or other sharp materials which can seriously damage a floor.

A need therefore exists for an improved brush and spacer assembly for upright vacuum cleaners.

SUMMARY OF THE INVENTION

It is therefore an object of the present invention to provide an improved brush spacer assembly for spacing a vacuum cleaner nozzle apart from a surface being vacuumed, and a vacuum cleaner having a brush spacer assembly that can move along a surface with the nozzle being maintained at a distance from the surface. The brush spacer assembly incorporates a main body, a plurality of bristles, and a spacer.

In one embodiment, the main body of the brush spacer assembly is an elongated member having a first portion, a second portion, a top surface and a base. The main body is preferably of unitary construction, approximately two inches in length, and made from plastic. The main body is removably attached to the underside of a vacuum cleaner nozzle, preferably along a side margin of the nozzle. The main body can be attached in close proximity to a channel in the nozzle that connects the area outside the nozzle with a dirty air intake opening in the bottom of the nozzle. The first portion of the main body is adapted to receive the spacer, and the second portion of the main body is adapted to receive the bristles.

The bristles can be any type of bristle commonly available to be used in a brush. Each bristle is elongated, preferably measuring approximately one inch in length, and has a proximate end and a distal end. The bristles can be gathered together in tufts. The proximate end of the bristles are attached to the second portion of the main body and the distal ends are extended below the base of the main body and toward the surface when the main body is oriented for use. The bristles can be directed downward and away from the center of the nozzle at an angle of approximately 45 degrees with respect to the surface. In such an embodiment, the bristles could intersect with the corner between a wall and the surface when the vacuum cleaner is aligned to travel along the wall.

The spacer is attached to the first portion of the main body, preferably in close proximity to the bristles, in order to prevent the proximate end of the bristle from approaching the surface. The spacer is preferably a wheel rotatably engaged with an axle. The wheel is received by a hollow located in the base of the first portion of the main body. The hollow is formed in the shape of a wheel well for closely receiving the wheel. The axle extends beyond a side portion of the wheel, with the exposed portion of the axle being received by a seat in the main body adjacent the wheel well. The wheel can rotate within the wheel well, with a perimeter of the wheel extending partially below the main body. The portion of the wheel that extends from the wheel well is large enough to prevent permanent distortion of the bristles, but small enough to not affect the contact between the opening in the bottom of the nozzle with the carpet. The perimeter preferably extends approximately ⅛ inch below the main body, although the space between the base of the main body and the perimeter of the wheel is adjustable to accommodate different sizes and types of bristles.

During operation, the main body is attached to the nozzle of the vacuum cleaner with the bristles directed downward and to the side of to the nozzle. The spacer is located in close proximity to the bristles. When the nozzle of the vacuum cleaner is positioned for use, the bristles contact the surface and are slightly bent. The spacer prevents the bristles from being excessively deformed when contacting the surface. As the nozzle moves across the surface following a path parallel to the wall, the bristles agitate dirt particles in the crack between the wall and the surface. Rapid air entering the channel in the nozzle entrains the dirt particles and carries them along with the air into the opening in the nozzle of the vacuum cleaner. The vacuum cleaner thus collects dirt from the corner between the wall and the surface.

As the nozzle stays in the position of use, either during storage or actual use, the bristles continue to be only slightly deformed by contact with the surface. The amount of bristle deformation can be adjusted by changing the thickness of the spacer or, in the preferred embodiment, changing the distance between the perimeter of the wheel and the main body. This distance can be large enough to prevent the bristles from becoming permanently deformed. The bristles can therefore maintain their resilience and can continue to agitate dirt trapped in the corner between the wall and the surface long after the vacuum cleaner has been put to use.

DETAILED DESCRIPTION OF THE INVENTION

The present invention is directed toward a removable brush spacer assembly for spacing a vacuum cleaner nozzle from a surface, and a vacuum cleaner having a brush assembly that can move along a surface with the brush being maintained at a selected distance from the surface. Many specific details of certain embodiments of the invention are set forth in the following description and in FIGS. 5–9 to provide a thorough understanding of such embodiments. One skilled in the art, however, will understand that the present invention may have additional embodiments, or that the invention may be practiced without several of the details described in the following description.

Figure 1:
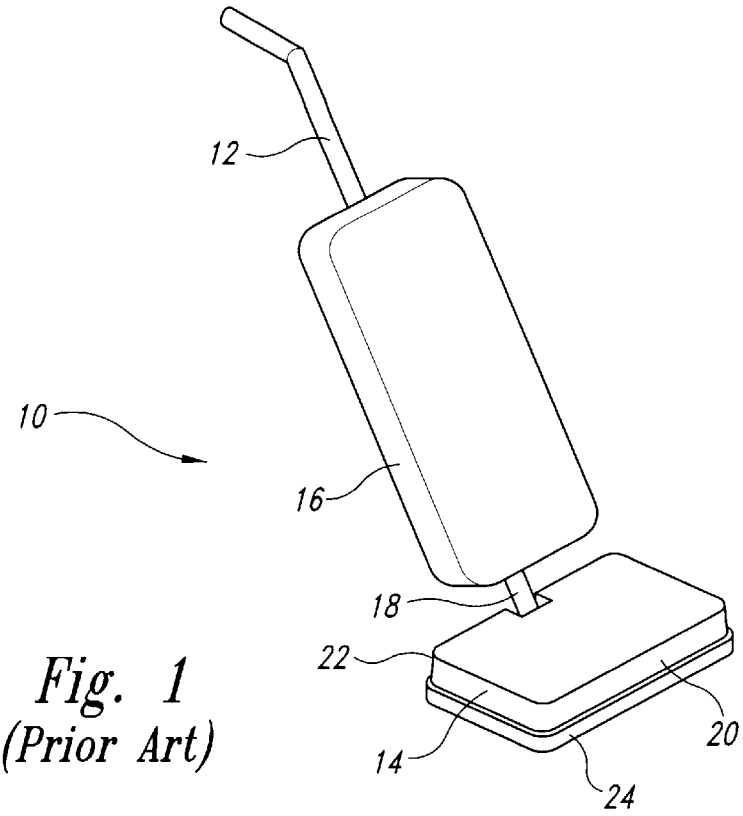
Fig. 1 (Prior Art)
FIG. 1 is an isometric illustrating a vacuum cleaner of the prior art.
Figure 2:
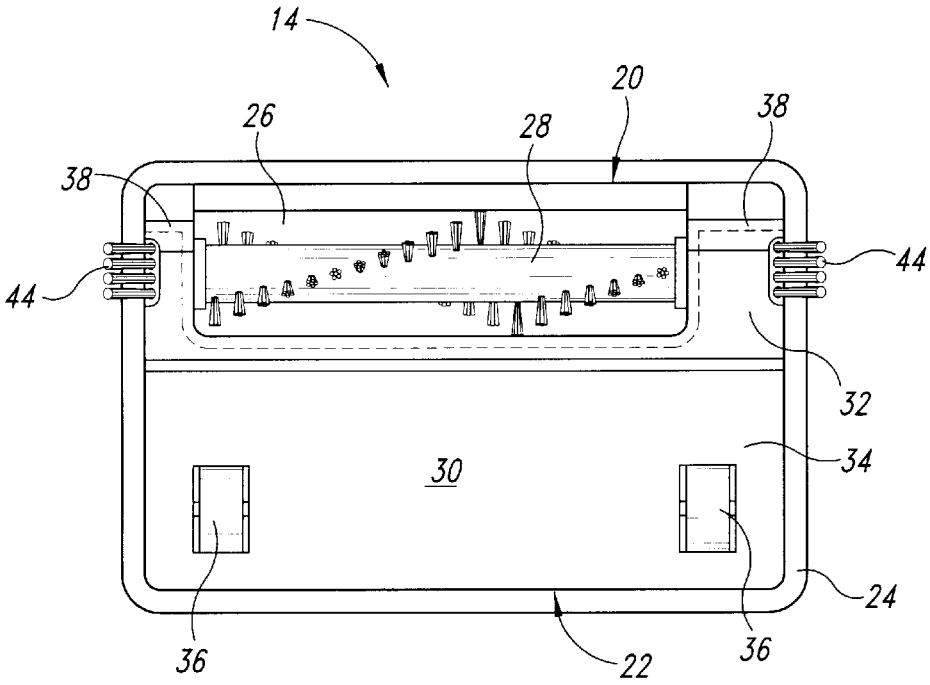
Fig. 2 (Prior Art)
FIG. 2 is a plan view from below of the base of a vacuum cleaner of the prior art.
Figure 3:
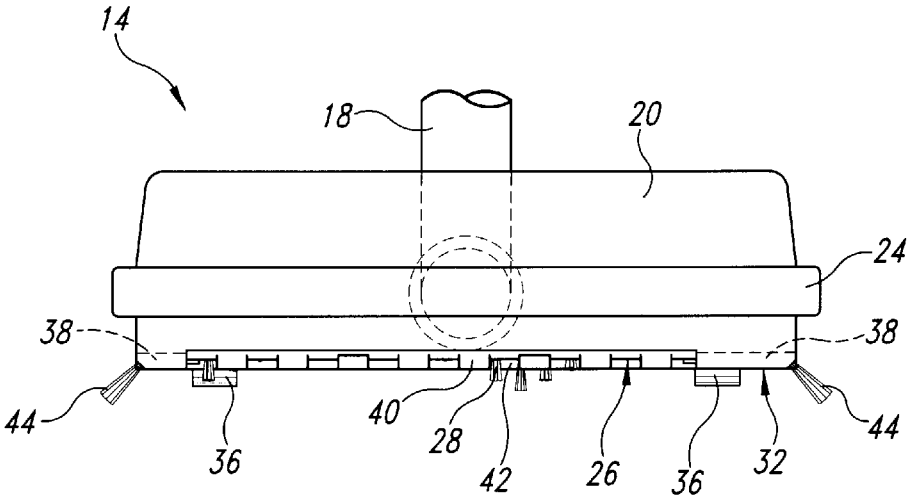
Fig. 3 (Prior Art)
FIG. 3 is an elevation view of the base of a vacuum cleaner of the prior art.
Figure 4:
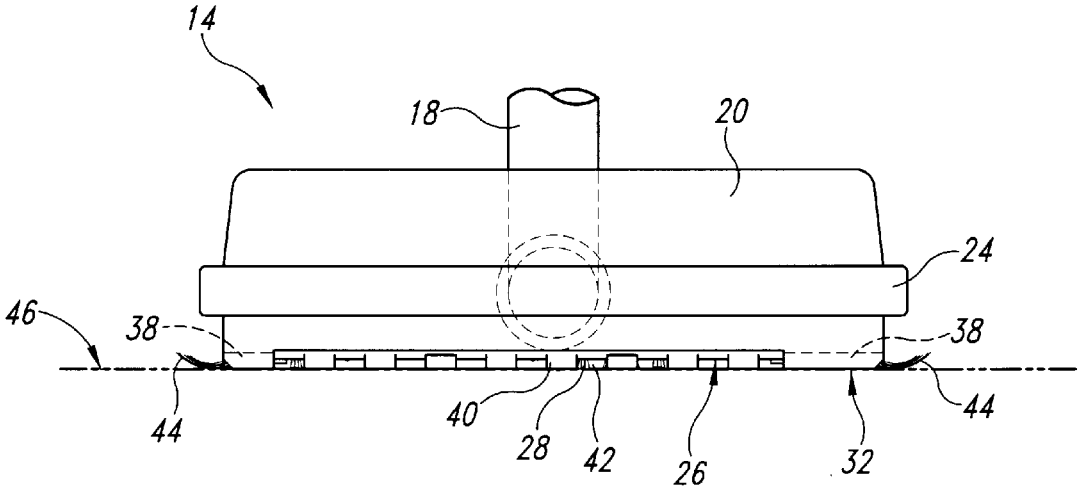
Fig. 4 (Prior Art)
FIG. 4 is an elevation view of the base of a vacuum cleaner of the prior art.
Figure 5:
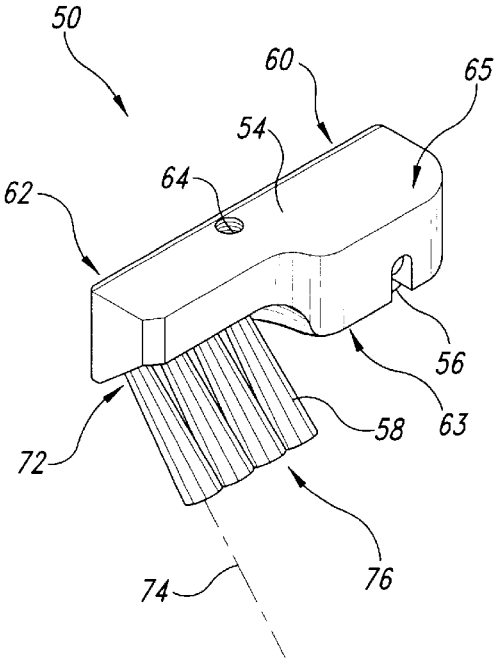
FIG. 5 is an isometric view of a spacer assembly according to one embodiment of the present invention.

FIG. 5 shows a brush spacer assembly 50 according to one embodiment of the present invention. As discussed in detail below, the brush spacer assembly 50 can be mounted to the bottom lateral edges of a nozzle 14 such as the head of the upright vacuum 10 to sweep dirt from a corner between a wall and a floor.

The illustrated brush spacer assembly 50 incorporates a main body 54, a wheel 56, and a plurality of brushes 58. The main body 54 is an elongated member having a first portion 60, a second portion 62, and a base 63. The main body 54 can also have a bore 64 central to a top surface 65 of the main body 54 into which a fastener (not shown) can be inserted from above to retain the brush spacer assembly 50 in contact with the vacuum cleaner 10. The main body 54 is preferably plastic, molded into a unitary element measuring approximately two inches in length.

Figure 6:
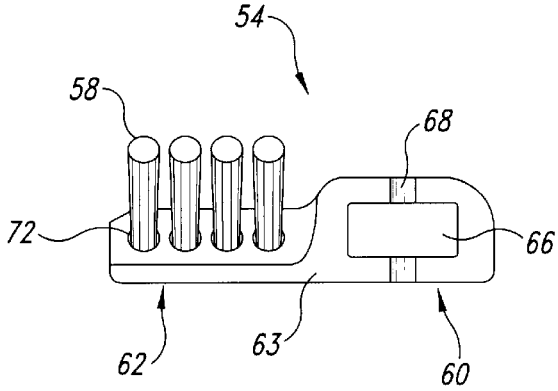
FIG. 6 is a plan view from below of a spacer assembly according to one embodiment of the present invention.
Figure 7:
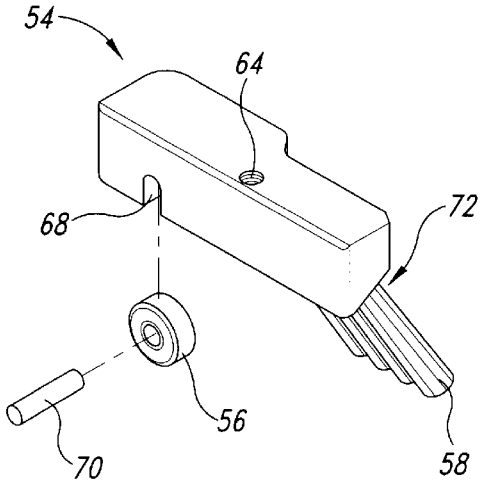
FIG. 7 is an exploded isometric view of a spacer assembly according to one embodiment of the present invention.

As shown in FIGS. 6 and 7, the first portion 60 of the main body 54 is adapted to receive the wheel 56, and the second portion 62 of the main body 54 is adapted to receive the brushes 58. The first portion 60 of the main body 54 has a wheel well 66 in the base 63 for receiving the wheel 56. The wheel well 66 is larger than the wheel 56 to allow the wheel 56 to be loosely inserted into the wheel well 66 and to rotate therein. The wheel well 66 closely receives the wheel 56 to prevent particles and hair or other fibers from entering the space between the wheel 56 and the wheel well 66.

The wheel 56 is approximately one-half inch in diameter and one-eighth inch wide, and is rotatably engaged with an axle 70 such that the terminal ends of the axle 70 extend beyond the wheel 56. The axle 70 engages a seat 68 in the base 63 of the main body 54 at a point where the wheel 56 is partially engaged with the wheel well 66. The wheel 56 extends beyond the surface of the wheel well 66. The wheel 56 can rotate freely on the axle 70 without contacting the inner surface of the wheel well 66.

The bristles are elongated fibers having a proximate end 72, a distal end, and a longitudinal axis 74. The bristles can be selected or manufactured from any existing bristle material, with the bristle stiffness being selected based on user demands. The bristles can be gathered together in a tuft 76 with the proximate ends 72 of the brushes 58 attached to the second portion 62 of the main body 54. The longitudinal axes 74 of the brushes 58 are directed away from the top surface 65 of the main body 54 and laterally with respect to the direction of travel of the vacuum cleaner. In the preferred embodiment, the brushes 58 are directed at an angle of approximately 45 degrees with respect to the surface. As such, the bristles are directed toward the corners where the floor 46 meets a wall. In the preferred embodiment, the brushes 58 measure approximately on inch in length.

Figure 8:
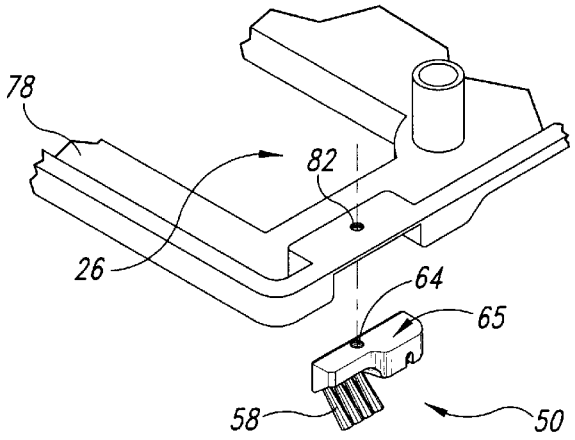
FIG. 8 is a partial isometric view of the bottom panel of a vacuum cleaner and a spacer assembly according to one embodiment of the present invention.
Figure 9:
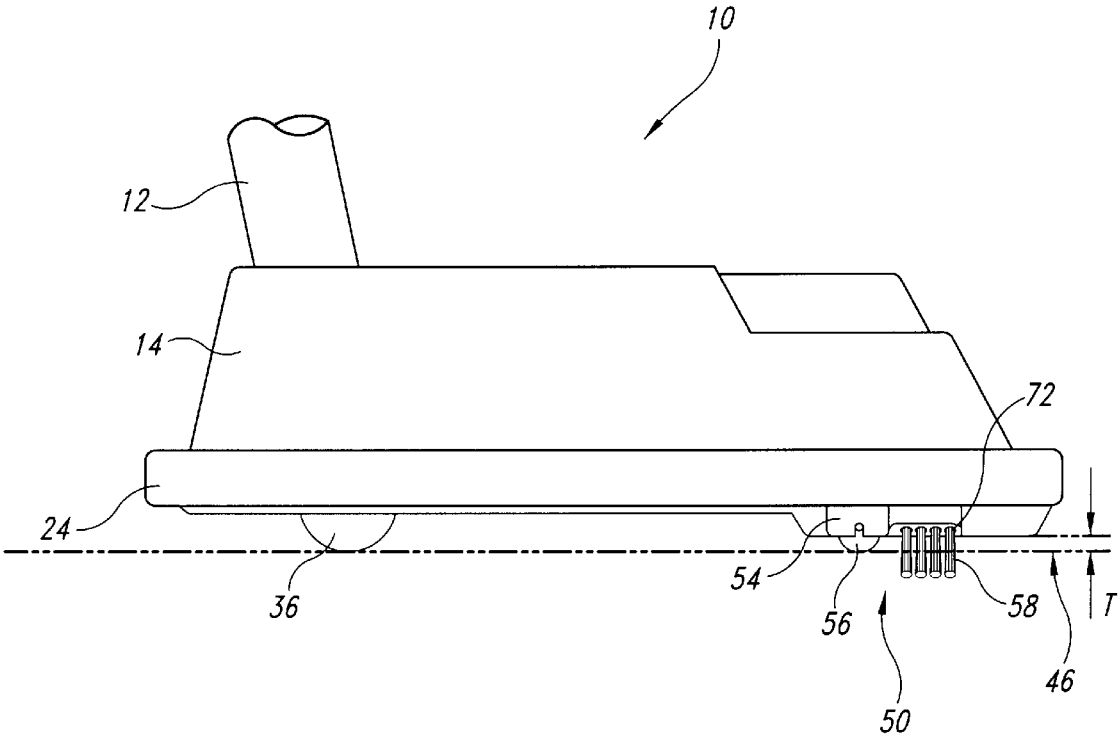
FIG. 9 is a side elevation view of the base of a vacuum cleaner and a spacer assembly according to one embodiment of the present invention.

As shown in FIGS. 8 and 9, the brush spacer assembly 50 is mounted to a bottom panel 78 of the nozzle 14. The brush spacer assembly 50 can be mounted on one or both sides of the vacuum cleaner 10. The bottom panel 78 can be formed to have a molded housing 80 to closely receive the top surface 65 of the main body 54. The bottom panel 78 can also have an aperture 82 through which a fastener (not shown) can be extended to releasably engage the bore 64 in the top surface 65.

During operations the brush spacer assembly 50 is positioned along the underside of the nozzle 14 of the vacuum cleaner 10. The main body 54 is oriented such that the bristles 58 are directed toward the floor 46. Upon contacting the floor 46, the bristles 58 are slightly deflected. The wheel 56 extends below the main body 54 and thereby prevents the proximate ends 72 of the bristles 58 from abutting the floor 46. The space T between the main body 54 and the floor 46 can be adjusted to compensate for bristles 58 made from different materials or having a different length. Any adjustment that is made to the space is completely within the control of the manufacturer of the spacer assembly 50, instead of being dependent on other parts of the nozzle 14, as with nozzles 14 of the prior art.

Unlike the support wheels 36 at the rear of the nozzle 14, the wheel 56 on the brush spacer assembly 50 is small enough to allow the nozzle 14 to float when rolling over a carpeted surface. When the nozzle 14 rolls over a carpeted surface, the lowered section 32 is able to contact the floor and allow the nozzle 14 to operate at optimum efficiency. When the vacuum cleaner 10 is operated over a hard surface, however, the wheel 56 on the brush spacer assembly 50 is able to raise the lowered section 32 off of the floor, protecting both the bristles 58 and the floor.

As the vacuum cleaner 10 travels along the length of a wall, the bristles 58 can agitate dirt in the corner between the wall and the floor 46, allowing the vacuum cleaner 10 to collect the dirt. When the vacuum cleaner 10 is used or is stored on a hard surface, the wheel 56 continues to prevent the proximate ends 72 of the bristles 58 from approaching the floor 46. Thus, contrary to the edge brushes of the prior art, the bristles 58 of the current invention may not become overly distorted. The wheel 56 also prevents the bottom panel 78 from contacting the floor 46. This separation can lessen the amount of damage to the floor that may have been caused by the vacuum cleaner 10 of the prior art.

An additional advantage of the invention is that the spacer assembly 50 is modular. By being modular, the spacer assembly 50 can be easily replaced or retrofitted into existing vacuum cleaners 10.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A removable brush spacer assembly for attachment to a lateral edge of a vacuum cleaner nozzle for supporting an edge brush and spacing the brush with respect to a surface, the brush spacer assembly comprising:

an elongated, unitary main body having a first end, an opposing second end and a base, the unitary main body configured to fixedly engage the nozzle;

a plurality of bristles forming an edge brush having a proximate end and a distal end, the proximate end of the brush being attached to the first end of the main body and fixedly projecting outward from the body with the distal end extending below the base and towards the surface;

a spacer attached to the second end of the main body and projecting below the base for engagement with the surface to control the relationship of the distal end of the brush with respect to the surface.

2. A removable brush spacer assembly, as claimed in claim 1, having a plurality of edge brushes attached to the main body and spaced from each other with each brush formed from a plurality of bristles.

3. A removable brush spacer assembly, as claimed in claim 1, wherein the edge brush is formed by a grouping of elongated, substantially straight bristles and the edge brush has a longitudinal axis which is oblique with respect to the surface.

4. A removable brush spacer assembly, as claimed in claim 3, wherein the longitudinal axis of the edge brush is at an angle of approximately 45 degrees with respect to the surface.

5. A removable brush spacer assembly, as claimed in claim 1, wherein the spacer comprises a rotatable wheel mounted on the main body for engaging and rolling over the surface.

6. A removable brush spacer assembly, as claimed in claim 5, wherein the spacer comprises a relatively small rotatable wheel which will not interfere with the relative positioning of the nozzle to the surface when the surface is readily deformable and will space the nozzle from the surface when the surface is hard.

7. A removable brush spacer assembly, as claimed in claim 5, wherein the wheel is mounted on an axle connected to the main body and the main body has a surface defining a hollow which forms a wheel well for closely receiving the wheel to minimize the collection of particles and fibers about the wheel and axle.

8. A removable brush spacer assembly, as claimed in claim 1, wherein the spacer separates the proximate end of the brushes from the surface by approximately ⅛ inch when the surface is a hard surface.

9. The removable brush spacer assembly of claim 1 wherein the bristles are configured into a plurality of tufts arranged in a substantially linear path along at least a portion of the first end of the main body.

10. An upright vacuum cleaner assembly to be rolled on a surface, the assembly comprising:

a handle;

a nozzle having a center, a side margin, and a bottom section, the bottom section being oriented near the surface;

a unitary spacer body having a first portion and a second portion, the spacer body fixedly attached to the bottom section of the nozzle near the side margin;

a plurality of bristles each having a proximate end and a longitudinal axis, the proximate end of the bristle being attached to the second portion of the spacer body in a fixed orientation with respect to the nozzle such that the longitudinal axis of the bristle is directed toward the surface; and a wheel attached to the first portion of the spacer body in close proximity to the bristles to prevent the proximate end of the bristle from approaching the surface.

11. The upright vacuum cleaner assembly of claim 10 wherein the first portion of the spacer assembly is adjacent the second portion of the spacer assembly.

12. The upright vacuum cleaner assembly of claim 10 wherein the spacer body is approximately two inches in length.

13. The upright vacuum cleaner assembly of claim 10 wherein the longitudinal axis of the bristle is oblique with respect to the surface.

14. The upright vacuum cleaner assembly of claim 13 wherein the longitudinal axis of the bristle is directed toward the surface at an angle of approximately 45 degrees.

15. The upright vacuum cleaner assembly of claim 10 wherein the wheel separates the proximate end of the bristle from the surface by approximately ⅛ inch.

16. The upright vacuum cleaner assembly of claim 10 wherein the bottom section comprises a bottom panel attached to the bottom of the nozzle, the bottom panel has a molded housing near the side margin, and the spacer body is fixedly received by the molded housing in the bottom panel.

17. The upright vacuum cleaner of claim 10 wherein the bristles are configured into a plurality of tufts arranged in a substantially linear path along at least a portion of the second portion of the spacer body.

* * * * *